US011865466B2

(12) United States Patent
Fouts et al.

(10) Patent No.: US 11,865,466 B2
(45) Date of Patent: Jan. 9, 2024

(54) CHILD PLAY PUZZLE

(71) Applicant: Lovevery, Inc., Boise, ID (US)

(72) Inventors: Philip J. Fouts, Boise, ID (US); Thomas Creason Rigby, Boise, ID (US); Sara Hall Richins, Boise, ID (US)

(73) Assignee: Lovevery, Inc., Boise, ID (US)

( * ) Notice: Subject to any disclaimer, the term of this patent is extended or adjusted under 35 U.S.C. 154(b) by 0 days.

(21) Appl. No.: 18/063,169

(22) Filed: Dec. 8, 2022

(65) Prior Publication Data

US 2023/0104388 A1 Apr. 6, 2023

Related U.S. Application Data

(63) Continuation of application No. PCT/US2020/036695, filed on Jun. 8, 2020.

(51) Int. Cl.
*A63F 9/08* (2006.01)
*A63F 9/00* (2006.01)

(52) U.S. Cl.
CPC ..... *A63F 9/0811* (2013.01); *A63F 9/0865* (2013.01); *A63F 2009/0075* (2013.01)

(58) Field of Classification Search
CPC ..... A63F 9/0811; A63F 9/0865; A63F 2009/0075
See application file for complete search history.

(56) References Cited

U.S. PATENT DOCUMENTS

| | | | | |
|---|---|---|---|---|
| 2,591,303 A | | 5/1948 | Schriner et al. | |
| 2,595,938 A | * | 5/1952 | Grant | A63F 9/0073 D21/471 |
| 2,738,979 A | * | 3/1956 | Dalton | A63F 9/0073 206/499 |
| 4,043,561 A | * | 8/1977 | Stepansky | A63F 9/0073 434/189 |

(Continued)

FOREIGN PATENT DOCUMENTS

| | | | |
|---|---|---|---|
| CN | 205073654 U | * | 3/2016 |
| CN | 205461023 U | * | 8/2016 |

(Continued)

OTHER PUBLICATIONS

Extended European Search Report in European Appln No. 20939830.4, dated Jun. 14, 2023, 7 pages.

(Continued)

*Primary Examiner* — Steven B Wong
(74) *Attorney, Agent, or Firm* — Fish & Richardson P.C.

(57) ABSTRACT

A child play puzzle includes a set of pieces each defining a non-circular aperture therethrough. The child play puzzle also includes a base and a pole extending from the base along a pole axis. The pole sequentially receives each piece of the set of pieces with the pole extending through the aperture of each piece to form a stack of the pieces along the pole. The pole has multiple sections spaced along its length. Each section is of non-circular cross-section in a plane perpendicular to the pole axis. At least one of the sections is rotatable about the pole axis with respect to an adjacent one of the sections, such that moving a piece from about the rotatable section to about the adjacent section requires rotationally aligning the rotatable section with the adjacent section.

14 Claims, 3 Drawing Sheets

(56) References Cited

U.S. PATENT DOCUMENTS

| | | | | | |
|---|---|---|---|---|---|
| 4,485,585 | A | * | 12/1984 | Shackelford | A63F 9/06 434/258 |
| 4,632,399 | A | * | 12/1986 | Bern | A63F 9/0811 273/155 |
| 4,742,703 | A | | 5/1988 | Dewalch et al. | |
| D359,083 | S | * | 6/1995 | Engelbrecht | D21/478 |
| 5,560,605 | A | * | 10/1996 | Garcia | A63F 9/0073 273/153 P |
| 5,992,851 | A | * | 11/1999 | Ajtai | A63F 9/0073 273/153 S |
| 6,755,713 | B1 | * | 6/2004 | Weber | A63H 5/00 446/175 |
| D599,416 | S | * | 9/2009 | Turco-Rivas | D21/471 |
| 2004/0046318 | A1 | * | 3/2004 | Christensen | A63F 9/0811 273/153 S |
| 2005/0288082 | A1 | * | 12/2005 | de la Huerga | A63F 9/0811 463/9 |
| 2008/0185781 | A1 | * | 8/2008 | Mascolo | A63F 9/0073 273/153 P |
| 2011/0057387 | A1 | * | 3/2011 | Yang | A63F 9/0865 273/153 S |
| 2019/0381394 | A1 | * | 12/2019 | Alexander | A63F 9/0073 |

FOREIGN PATENT DOCUMENTS

| | | | | | |
|---|---|---|---|---|---|
| CN | 205672560 | U | * | 11/2016 | |
| CN | 206823187 | U | * | 1/2018 | |
| CN | 109289212 | A | * | 2/2019 | |
| DE | 9317527 | U1 | * | 4/1994 | |
| GB | 2225248 | A | * | 5/1990 | A63F 9/0073 |
| GB | 2236955 | A | * | 4/1991 | A63F 9/0073 |
| GB | 2351921 | A | * | 1/2001 | A63F 7/042 |

OTHER PUBLICATIONS

International Preliminary Report on Patentability in International Appln. No. PCT/US2020/036695, dated Dec. 22, 2022, 9 pages.

International Search Report and Written Opinion in International Appln. No. PCT/US2020/036695, dated Sep. 11, 2020, 10 pages.

Skoolzy, "12 Ways to Use Your Pegboard Stacking Toy!," Oct. 1, 2017, retrieved on Aug. 18, 2020, retrieved from URL<https://skoolzy.com/blogs/news/pegboards-a-busy-moms-favorite-toy-10-ways-a-skoolzy-pegbaord-set-will-engage-your-child-and-free-up-your-time>, 14 pages.

* cited by examiner

CHILD PLAY PUZZLE

CROSS-REFERENCE TO RELATED APPLICATIONS

This application is a continuation application of and claims the benefit of priority to International PCT Patent Application Number PCT/US2020/036695, filed on Jun. 8, 2020, the contents of which are hereby incorporated by reference.

TECHNICAL FIELD

This invention relates to toys, and more particularly to child play puzzles.

BACKGROUND

There are different types of child play puzzles such as jigsaw, construction, and combination puzzles. Puzzles can have different levels of difficulty. Children can develop memory and motor skills such as hand-eye coordination and shape recognition by playing with puzzles of appropriate levels of difficulty. It is desirable that such puzzles be safe, easy to set up, and appropriate for children of different ages.

SUMMARY

Implementations of the present disclosure include a child play puzzle that includes a set of pieces. Each piece defines a non-circular aperture therethrough. The child play puzzle also includes a base and a pole extending from the base along a pole axis. The pole sequentially receives each piece of the set of pieces with the pole extending through the aperture of each piece to form a stack of the pieces along the pole. The pole has multiple sections spaced along its length. Each section is of non-circular cross-section in a plane perpendicular to the pole axis. At least one of the sections is rotatable about the pole axis with respect to an adjacent one of the sections, such that moving a piece from about the rotatable section to about the adjacent section requires rotationally aligning the rotatable section with the adjacent section.

In some implementations, the adjacent section is rotationally fixed with respect to the base.

In some implementations, the adjacent section is disposed between the rotatable section and a second section rotatable about the pole axis with respect to the adjacent section such that moving the piece from about the adjacent section to about the second rotatable section requires rotationally aligning the second rotatable section with the adjacent section. In some examples, the second rotatable section is disposed between the adjacent section and a second adjacent one of the sections disposed between the base and the second rotatable section such that moving the piece from about the second rotatable section to about the second adjacent section requires rotationally aligning the second rotatable section with the second adjacent section. In some implementations, the adjacent section is arranged offset with respect to the second adjacent section such that moving the piece from about the adjacent section to about the second adjacent section requires first rotationally aligning the second rotatable section with the adjacent section, and then rotationally aligning the second rotatable section with the second adjacent section. In some implementations, the rotatable section and the second rotatable section are of a first color and the adjacent section and the second adjacent section are of a second color different than the first color.

In some implementations, each section of the multiple sections is of a common cross-section shape and size, and the non-circular aperture of each piece is of a size and shape to match the common cross-section shape and size of the sections. In some implementations, each section of the multiple sections defines a polygonal cross-section.

In some implementations, the pole is attached to the base so as to extend vertically with the base on a horizontal surface. In some implementations, the pieces of the set have different overall widths, measured across their apertures.

In some implementations, the child play puzzle also includes a second set of pieces each defining a non-circular aperture therethrough. The child play puzzle also includes a second pole spaced from the pole and extends from the base along a second pole axis. The second pole sequentially receives each piece of the second set of pieces with the second pole extending through the aperture of each piece to form a stack of the pieces along the second pole. The second pole has second sections spaced along its length, each section being of non-circular cross-section in a plane perpendicular to the pole axis. A first section of the second sections is rotationally misaligned with a second section of the second sections and spaced from the second section to define a gap therebetween, such that moving a piece from about the first section to about the second section requires rotationally aligning, at the gap, the piece with the second section.

In some implementations, the second sections are rotationally fixed with respect to each other.

In some implementations, each of the second sections includes one or more ribs extending away from the second pole and along the second pole axis.

Implementations of the present disclosure also include a child play puzzle set that includes a base, a first play module supported on the base, a second play module supported on the base, and a third play module supported on the base. The first play module includes a first set of pieces each defining a non-circular aperture therethrough. The first play module also includes a first pole extending from the base along a first pole axis. The first pole sequentially receives each piece of the first set of pieces with the first pole extending through the aperture of each piece to form a stack of the pieces along the first pole. The first pole includes sections spaced along its length, each section being of non-circular cross-section in a plane perpendicular to the first pole axis. At least one of the sections is rotatable about the first pole axis with respect to an adjacent one of the sections, such that moving a piece from about the rotatable section to about the adjacent section requires rotationally aligning the rotatable section with the adjacent section. The second play module is spaced from the first play module. The second play module includes a second set of pieces each defining a non-circular aperture therethrough. The second play module also includes a second pole extending from the base along a second pole axis. The second pole sequentially receives each piece of the second set of pieces with the second pole extending through the aperture of each piece to form a stack of the pieces along the second pole. The second pole includes second sections spaced along its length, each section being of non-circular cross-section in a plane perpendicular to the pole axis. A first section of the second sections is rotationally misaligned with a second section of the second sections and spaced from the second section to define a gap therebetween, such that moving a piece from about the first section to about the second section requires rotationally aligning, at the gap, the piece with the second section. The third play module is spaced from the first play module and includes a third set of pieces each defining a threaded aperture therethrough. The third play module also includes a third pole that extends from the base along a third pole axis. The third pole has an exterior thread to threadedly receive each piece of the third set of pieces with the third pole extending through the aperture of each piece to form a stack of the pieces along the third pole.

Implementations of the present disclosure also include a method of child play. The method includes obtaining a child play puzzle that includes 1) a set of pieces each defining a non-circular aperture therethrough, 2) a base, and 3) a pole extending from the base along a pole axis. The pole sequentially receives each piece of the set of pieces with the pole extending through the aperture of each piece to form a stack of the pieces along the pole. The pole has a plurality of sections spaced along its length. Each section is of non-circular cross-section in a plane perpendicular to the pole axis. At least one of the sections is rotatable about the pole axis with respect to an adjacent one of the sections, such that moving a piece from about the rotatable section to about the adjacent section requires rotationally aligning the rotatable section with the adjacent section. The method also includes inserting a piece of the set of pieces through the pole to dispose the aperture of the piece about the rotatable section. The method also includes rotationally aligning the rotatable section with the adjacent section, and moving, with the rotatable section aligned with the adjacent section, the piece from about the rotatable section to about the adjacent section.

In some implementations, inserting the piece includes engaging, with the aperture of the piece, an exterior surface of the rotatable section. Rotationally aligning the rotatable section with the adjacent section includes rotating the inserted piece to rotate the rotatable section.

Implementations of the present disclosure also include a method of setting up a child play puzzle. The method includes obtaining a child play puzzle that includes 1) a base, 2) multiple blocks each defining an aperture therethrough, and 3) a pole extending from the base along a pole axis. The pole sequentially receives each block with the pole extending through the aperture of each block. At least a section of the pole defines a non-circular cross-section. At least one of the blocks defines a non-circular aperture such that, with the block inserted in the pole, the block is rotationally locked with respect to the pole. At least one of the blocks is a rotatable block defining an aperture that allows, with the block inserted in the pole, rotation of the block about the pole axis with respect to the pole. The method also includes inserting the blocks in the pole alternatingly such that at least one rotatable block is adjacent a rotationally locked block. The method also includes rotating the rotatable block about the pole axis to misalign the rotatable block with respect to the rotationally locked block.

In some implementations, at least two of the rotationally locked blocks define cross-sections that, when inserted in the pole, are misaligned with respect to each other. Inserting the blocks includes inserting a rotatable block between the two rotationally locked blocks such that the rotatable block is always misaligned with at least one of the two rotationally locked blocks. In some examples, the pole defines a longitudinal groove extending along a length of the pole and the at least one rotationally locked block has an inwardly projecting shoulder extending from the aperture. The longitudinal groove receives the inwardly projecting shoulder with the rotationally locked block inserted in the pole to prevent rotation of the block with respect to the pole.

In some cases, the second pole is disposed between the pole and the third pole. The poles are spaced from each other to allow stacking of each set of pieces on their respective poles at the same time. Each pole extends vertically from a common surface of the base and is arranged parallel to each other.

Various embodiments of these concepts may help to promote child's learning and stimulate development during play. Having multiple puzzles or play modules of different levels of difficulty in one board allows a child to use the toy for months or even years of development. The multiple puzzles have a common fundamental goal but each requires different executions to solve the puzzle, which can teach a child how similar goals can be approached in different ways. For example, the puzzles have common solving patterns (e.g., all puzzles require rotating the pieces and moving the pieces from top to bottom) with each puzzle increasing in difficulty from left to right. Additionally, having multiple puzzles with varying levels of difficulty provides the opportunity for both individual exploratory play by the child and parent engagement with the more complex puzzles of the toy. The large pieces of the puzzle are safe for small children to play with. The pieces of each puzzle or play module can be similar in size and shape, which may require a child to figure out which pieces go in which pole to promote problem-solving skills. Lastly, each set of pieces is of a different family of color, with each piece of the corresponding set having a similar color and the corresponding pole having a similar color than at least one of the pieces. Such configuration can aid a child in problem-solving and promote visual learning.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
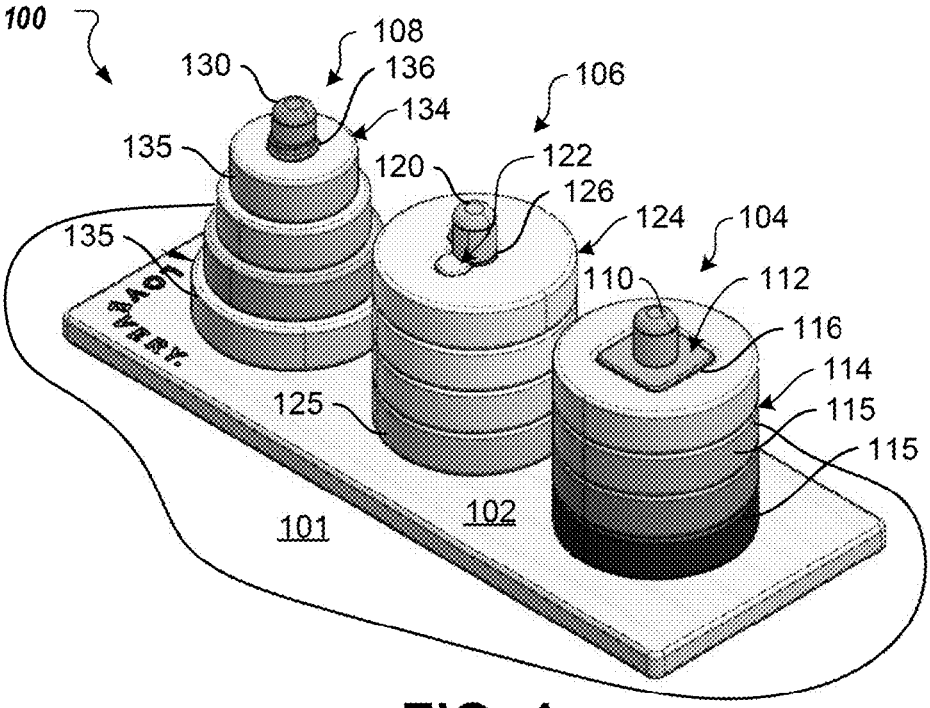
FIG. 1 is a perspective view of a child play puzzle with removable pieces.

Referring to FIG. 1, a child play puzzle 100 or puzzle set includes a base 102 and three play modules 104, 106, and 108 supported on base 102. Base 102 can be a rectangular board that is supportable on a horizontal surface 101. A first module 104 of the three play modules is a child play puzzle (e.g., a twist and pivot puzzle) that includes a first pole 110, a set of blocks 112 or sections coupled to pole 110, and a set of pieces 114 (e.g., removable pieces) that can be inserted in and stacked along pole 110. A second module 106 of the three play modules is a child play puzzle with a second pole 120, multiple sections 122 coupled to or extending from second pole 120, and a second set of removable pieces 124 that can be inserted in and stacked along second pole 120. Second play module 106 is spaced from first play module 104. A third play module 108 spaced from first play module 104 and second play module 106 includes a threaded pole 130 and a third set of removable pieces 134 that can be threadedly inserted in and stacked along pole 130. First play module 104 may feature a higher level of difficulty than second and third play modules.

Figure 2:
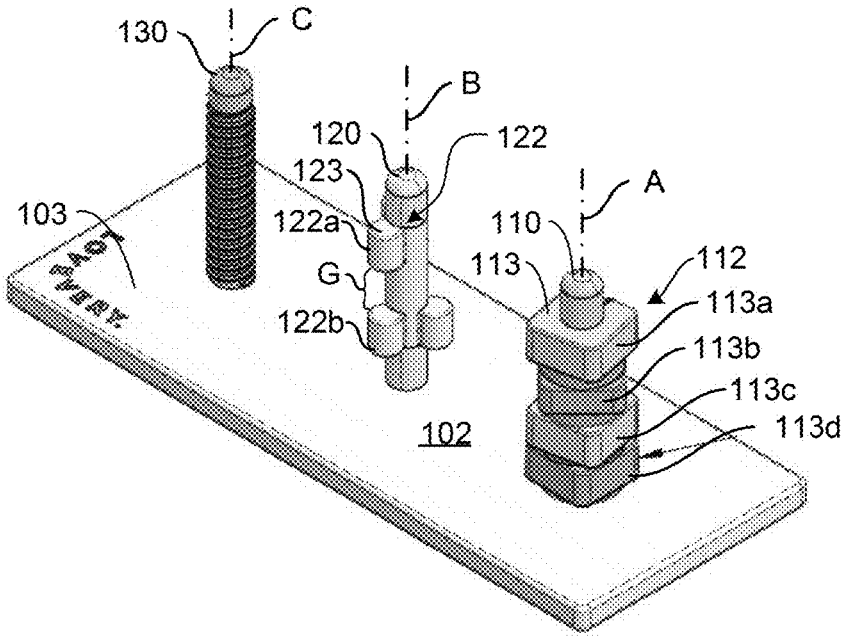
FIG. 2 is a perspective view of the child play puzzle of FIG. 1, without the removable pieces.

Referring also to FIG. 2, first pole 110 extends from board 102 along a first pole axis 'A', second pole 120 extends from board 102 along a pole axis 'B', and third pole 130 extends from board 102 along a pole axis 'C'. Each of pole axes 'A', 'B', and 'C' is perpendicular to a broad surface 103 of base 102. Thus, each pole 110, 120, 130 is attached to base 102 so as to extend vertically from base 102 and parallel with respect to each other, with base 102 supported on horizontal surface 101. In some implementations, the poles can extend horizontally from a vertical base or at an angle. The poles 110, 120, and 130 are spaced from each other to allow stacking of each set of pieces on their respective poles at the same time.

As shown in FIG. 1, first pole 110 sequentially receives each piece 115 of set of pieces 114 with pole 110 extending through a non-circular aperture 116 of each piece 115 to form a stack of the pieces 115 along pole 110. As shown in FIG. 2 and as further described in detail below with respect to FIGS. 3-6, pole 110 has multiple sections or blocks 113 spaced or disposed along its length. Each block 113 has a non-circular cross-section (e.g., a non-circular periphery) in a plane perpendicular to first pole axis 'A'. At least one block 113*a* is rotatable about first pole axis 'A' with respect to an adjacent block 113*b* such that moving a piece 115 from about rotatable block 113*a* to about adjacent block 113*b* requires rotationally aligning rotatable block 113*a* with adjacent block 113*b*. Rotatable block 113 can be aligned before or after inserting piece 115. For example, when piece 115 is inserted in pole 110 and disposed about rotatable block 113*a*, aperture 116 of piece 115 engages the exterior surface of rotatable block 113*a* so that rotating the piece 115 rotates rotatable section 113*a*.

As shown in FIG. 2, adjacent block 113*b* is rotationally fixed with respect to base 102. For example, with pole 110 rotationally fixed to base 102, adjacent block 113*b* (e.g., a rotationally fixed block) can be coupled to pole 110 to prevent rotation of adjacent block 113*b* with respect to pole 110 and base 102.

Rotationally fixed block 113*b* is disposed between first rotatable block 113*a* and a second rotatable block 113*c* such that moving a piece from about first rotationally fixed block 113*b* to about second rotatable block 113*c* requires rotationally aligning second rotatable block 113*c* with first rotationally fixed block 113*b*.

Second rotatable block 113*c* resides between rotationally fixed block 113*b* and a second adjacent block 113*d* (e.g., a second rotationally fixed block) that is disposed between base 102 and second rotatable block 113*c*. Similar to first rotationally fixed block 113*b*, second rotationally fixed block 113*d* is fixed against rotation with respect to base 102. Similar to rotatable block 113*a*, second rotatable block 113*c* rotates about pole axis 'A' with respect to second rotationally fixed block 113*d* such that moving a piece 115 from about second rotatable block 113*c* to about second rotationally fixed block 113*d* (e.g., to reach base 102 with piece 115) requires rotationally aligning second rotatable block 113*c* with second rotationally fixed block 113*d*.

First rotationally fixed block 113*b* is misaligned (e.g., arranged with offset corners) with respect to second rotationally fixed block 113*d*. Such arrangement requires that, when moving a piece 115 from about first rotationally fixed block 113*b* to about second rotationally fixed block 113*d*, one must first rotationally align second rotatable block 113*c* with rotationally fixed block 113*b*, and then, once piece 115 is about second rotatable block 113*c*, rotationally align second rotatable block 113*c* with second rotationally fixed block 113*d*.

First rotatable block 113*a* and the second rotatable block 113*c* can be of a first color different than a color of the first and second rotationally fixed blocks 113*b* and 113*d*. Each block 113 of the set of blocks 112 can have a common cross-section shape and size. For example, each block 113 has a polygonal cross-section (e.g., square) of same or similar size. Each removable piece 115 defines a central non-circular aperture 116 therethrough. Non-circular aperture 116 of each piece 115 can be of a size and shape to match the common cross-section shape and size of blocks 113. Pieces 115 can have different overall widths, measured across their apertures 116.

As shown in FIG. 1, second pole 120 sequentially receives each piece 125 of set of pieces 124 with second pole 120 extending through a non-circular aperture 126 of each piece 125 to form a stack of the pieces 125 along pole 120. As shown in FIG. 2, second pole 120 has multiple sections 122 spaced along its length, each including one or more ribs 123 (e.g., rounded ribs) extending away from second pole 120 and along second pole axis 'B'. In other words, each section 122 has a non-circular cross-section in a plane perpendicular to second pole axis 'B'. A first section 122*a* is rotationally misaligned with a second section 122*b* and is spaced from second section 122*b* to define a gap 'G' therebetween. Such configuration requires that moving a piece 125 of the second set of pieces 124 from about the first section 122*a* to about the second section 122*b* requires rotationally aligning, at gap 'G', piece 125 (e.g., aligning the non-circular aperture of the piece 125) with second section 122*b*.

Rounded ribs 123 are arranged in groups or sections 122 along the length of pole 120, with each rounded rib 123 of section 122 disposed at a different radial location of pole 120 and at the same vertical elevation along pole 120. Each section 122 can be rotationally fixed with respect to each other. For example, each section 122 can be rotationally fixed with respect to base 102 or, if rotatable about axis 'B', all sections 122 rotate together in the same direction.

Third pole 130 sequentially receives each piece 135 of set of pieces 134 with third pole 120 extending through a circular aperture 136 of each piece 135 to form a stack of the pieces 134 along pole 130. Circular aperture 136 of each piece 135 is a threaded hole and third pole 130 has an exterior thread that threadedly receives each piece 135. As shown in FIG. 2, third set of pieces 134 includes pieces 135 of different sizes. For example, pieces 135 can have a circular shape, with each piece 135 having a different outer diameter.

Figure 3:
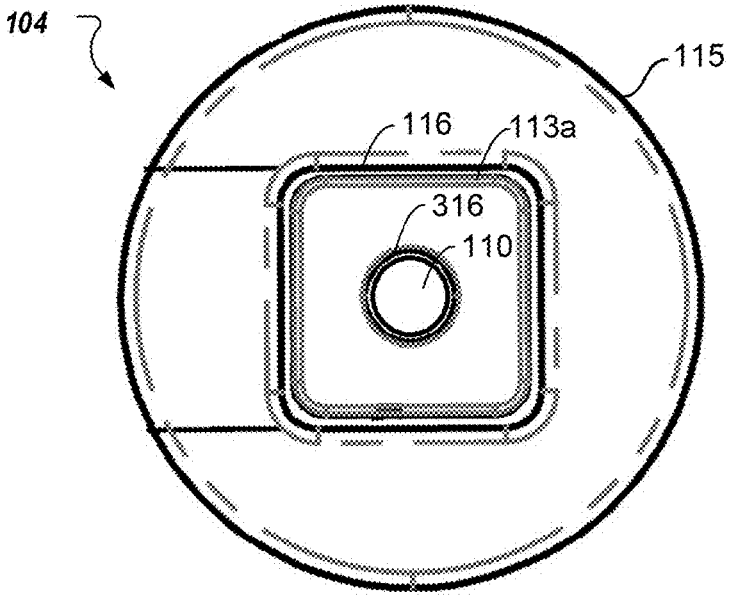
FIG. 3 is a top view of a first play module of the child play puzzle of FIG. 1

FIGS. 3-6 illustrate different elements of first child play module 104. FIG. 3 is a top view of first play module 104, featuring first block 113*a* of play module 104 rotationally coupled to pole 110. To insert piece 115 in pole 110 about first block 113*a*, the square-shaped aperture 116 of piece 115 is aligned with rotatable block 113*a*. The square cross-section of aperture 116 corresponds with the square cross-section perimeter of block 113*a* so that rotating piece 115 rotates block 113*a*. Similarly, piece 115 rotates the second rotatable block 113*c* (see FIG. 2).

Figure 4:
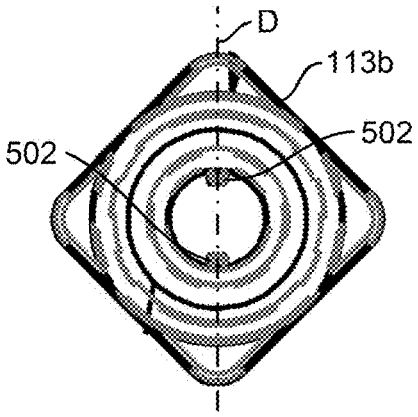
FIG. 4 is a top view of a first non-rotatable block of the first play module of FIG. 3.
Figure 5:
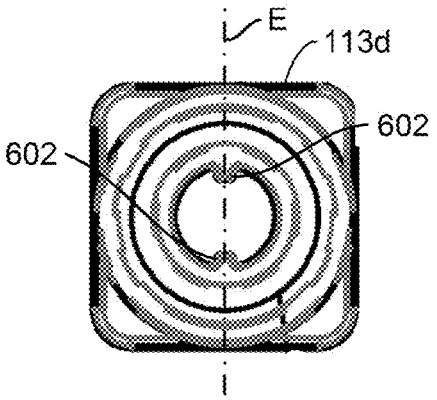
FIG. 5 is a top view of a second non-rotatable block of the play module of FIG. 3.

FIGS. 4 and 5 show the two blocks 113*b* and 113*d* that, when inserted or assembled in pole 110, are rotationally fixed to pole 110. For example, as shown in FIG. 4, first non-rotatable block 113*b* has one or more inwardly projecting shoulders 502 arranged along a diagonal axis 'D' that extends between opposite vertices of block 113*b*. As shown in FIG. 5, second non-rotatable block 113*d* has one or more inwardly projecting shoulders 602 arranged in an axis 'E' that extends symmetrically between two opposite sides of block 113*d*, across a center of block 113*d*. Such shoulders 502 and 602 engage a common groove of pole 110 to prevent blocks 113*b* and 113*d* from rotating with respect to pole 110.

Figure 6:
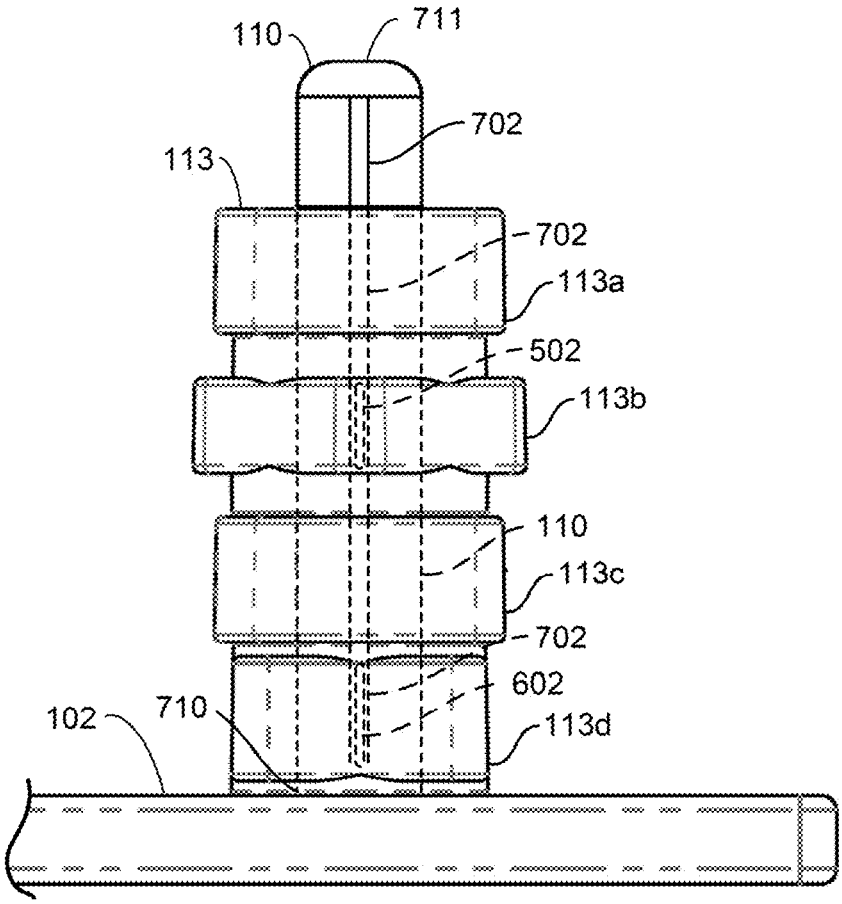
FIG. 6 is a side view of the first play module of FIG. 3, without the removable pieces.

FIG. 6 shows pole 110 with a longitudinal groove 702 extending along a length of pole 110 from or near a base 710 of pole 110 to or near a top end 711 of pole 110. In some implementations, groove 702 can extend along a portion of pole 110 or be a discontinuous groove. Longitudinal groove 702 receives inwardly projecting shoulder 502 of first non-rotatable block 113*b* to prevent rotation of the block 113*b* with respect to pole 110. Longitudinal groove 702 also receives inwardly projecting shoulder 602 of second non-rotatable block 113*d* to prevent rotation of the block 113*d* with respect to pole 110. The arrangement of respective shoulders 502 and 602 is such that when blocks 113*b* and 113*d* are inserted in pole 110, the blocks are misaligned with respect to each other and a rotatable block 113*c* between the two non-rotatable blocks is always misaligned with at least one of the two non-rotatable blocks.

To set up play module 104, a user may insert rotatable and non-rotatable blocks in an alternating arrangement as shown in FIG. 6, or place more than one rotatable block between two non-rotatable blocks. Additionally, before inserting pieces 115, a user (e.g., a parent) can rotate the rotatable blocks 113*a* and 113*c* to misalign the rotatable blocks with respect to the adjacent rotationally locked block.

While a number of examples have been described for illustration purposes, the foregoing description is not intended to limit the scope of the invention, which is defined by the scope of the appended claims. There are and will be other examples and modifications within the scope of the following claims.

What is claimed is:

1. A child play puzzle, comprising:

a set of pieces each defining a non-circular aperture therethrough;

a base; and a pole extending from the base along a pole axis, the pole configured to sequentially receive each piece of the set of pieces with the pole extending through the aperture of each piece to form a stack of the pieces along the pole, the pole comprising a plurality of sections spaced along its length, each section being of non-circular cross-section in a plane perpendicular to the pole axis, wherein at least one of the sections is rotatable about the pole axis with respect to an adjacent one of the sections that is rotationally fixed with respect to the base, such that moving a piece from about the rotatable section to about the adjacent section requires rotationally aligning the rotatable section with the adjacent section.

2. The child play puzzle of claim 1, wherein the adjacent section is also rotationally fixed with respect to the pole, and the adjacent section is disposed between the at least one of the sections that is rotatable and the base.

3. The child play puzzle of claim 2, wherein the adjacent section is disposed between the rotatable section and a second section rotatable about the pole axis with respect to the adjacent section such that moving the piece from about the adjacent section to about the second rotatable section requires rotationally aligning the second rotatable section with the adjacent section.

4. The child play puzzle of claim 3, wherein the second rotatable section is disposed between the adjacent section and a second adjacent one of the sections disposed between the base and the second rotatable section such that moving the piece from about the second rotatable section to about the second adjacent section requires rotationally aligning the second rotatable section with the second adjacent section.

5. The child play puzzle of claim 4, wherein the adjacent section is arranged offset with respect to the second adjacent section such that moving the piece from about the adjacent section to about the second adjacent section requires first rotationally aligning the second rotatable section with the adjacent section, and then rotationally aligning the second rotatable section with the second adjacent section.

6. The child play puzzle of claim 4, wherein the rotatable section and the second rotatable section comprise a first color and the adjacent section and the second adjacent section comprise a second color different than the first color.

7. The child play puzzle of claim 1, wherein each section of the plurality of sections is of a common cross-section shape and size, and wherein the non-circular aperture of each piece has a cross-section that corresponds with the common cross-section of the plurality of sections.

8. The child play puzzle of claim 7, wherein each section of the plurality of sections is polygonal, defining a polygonal cross-section.

9. The child play puzzle of claim 1, wherein the pole is attached to the base so as to extend vertically with the base resting and supported on a horizontal surface.

10. The child play puzzle of claim 9, wherein the pieces of the set have different overall widths, measured across their apertures.

11. The child play puzzle of claim 1, further comprising:

a second set of pieces each defining a non-circular aperture therethrough; and a second pole spaced from the pole and extending from the base along a second pole axis, the second pole configured to sequentially receive each piece of the second set of pieces with the second pole extending through the aperture of each piece to form a stack of the pieces along the second pole, the second pole comprising a second plurality of sections spaced along its length, each section being of non-circular cross-section in a plane perpendicular to the pole axis, wherein a first section of the second plurality of sections is rotationally misaligned with a second section of the second plurality of sections and spaced from the second section to define a gap therebetween, such that moving a piece from about the first section to about the second section requires rotationally aligning, at the gap, the piece with the second section.

12. The child play puzzle of claim 11, wherein the second plurality of sections are rotationally fixed with respect to each other.

13. The child play puzzle of claim 11, wherein each of the second plurality of sections comprises one or more ribs extending away from the second pole.

14. A child play puzzle set comprising:

a base;

a first play module supported on the base, the first play module comprising:

a first set of pieces each defining a non-circular aperture therethrough, and a first pole extending from the base along a first pole axis, the first pole configured to sequentially receive each piece of the first set of pieces with the first pole extending through the aperture of each piece to form a stack of the pieces along the first pole, the first pole comprising a plurality of sections spaced along its length, each section being of non-circular cross-section in a plane perpendicular to the first pole axis, wherein at least one of the sections is rotatable about the first pole axis with respect to an adjacent one of the sections that is rotationally fixed with respect to the base, such that moving a piece from about the rotatable section to about the adjacent section requires rotationally aligning the rotatable section with the adjacent section;

a second play module supported on the base and spaced from the first play module, the second play module comprising:

a second set of pieces each defining a non-circular aperture therethrough, and a second pole extending from the base along a second pole axis, the second pole configured to sequentially receive each piece of the second set of pieces with the second pole extending through the aperture of each piece to form a stack of the pieces along the second pole, the second pole comprising a second plurality of sections spaced along its length, each section being of non-circular cross-section in a plane perpendicular to the pole axis, wherein a first section of the second plurality of sections is rotationally misaligned with a second section of the second plurality of sections and spaced from the second section to define a gap therebetween, such that moving a piece from about the first section to about the second section requires rotationally aligning, at the gap, the piece with the second section; and a third play module supported on the base and spaced from the first play module, the third play module comprising:

a third set of pieces each defining a threaded aperture therethrough; and a third pole extending from the base along a third pole axis, the third pole comprising an exterior thread and configured to threadedly receive each piece of the third set of pieces with the third pole extending through the aperture of each piece to form a stack of the pieces along the third pole.

* * * * *